US007200909B2

(12) United States Patent
Peckham et al.

(10) Patent No.: US 7,200,909 B2
(45) Date of Patent: Apr. 10, 2007

(54) RIVETING APPARATUS

(75) Inventors: David Peckham, St. Thomas (CA); Peter Greengrass, London (CA); Renee Gregory Scheele, St. Thomas (CA)

(73) Assignee: Magna Structural Systems Inc., Aurora, Ontario (CA)

( * ) Notice: Subject to any disclaimer, the term of this patent is extended or adjusted under 35 U.S.C. 154(b) by 99 days.

(21) Appl. No.: 10/482,261

(22) PCT Filed: Jun. 26, 2002

(86) PCT No.: PCT/CA02/00996

§ 371 (c)(1),
(2), (4) Date: Dec. 23, 2003

(87) PCT Pub. No.: WO03/000446

PCT Pub. Date: Jan. 3, 2003

(65) Prior Publication Data

US 2004/0154372 A1 Aug. 12, 2004

(51) Int. Cl.
*B23P 11/00* (2006.01)
*B27C 3/06* (2006.01)

(52) U.S. Cl. ..... 29/243.54; 72/453.19

(58) Field of Classification Search ..... 29/243.54, 29/243.53; 72/453.19, 411, 477
See application file for complete search history.

(56) References Cited

U.S. PATENT DOCUMENTS 1,862,895 A * 6/1932 Jackson ..... 29/243.54
3,581,373 A * 6/1971 Murdoch et al. ..... 29/243.54
3,952,401 A * 4/1976 Wagner ..... 29/243.53
4,864,713 A * 9/1989 Roberts et al. ..... 29/243.54
4,955,119 A * 9/1990 Bonomi et al. ..... 29/243.54
5,060,362 A * 10/1991 Birke et al. ..... 29/243.53
5,557,835 A * 9/1996 Brandts ..... 29/243.54
5,771,551 A * 6/1998 Schurter et al. ..... 29/243.54

FOREIGN PATENT DOCUMENTS

GB 593538 * 10/1947

* cited by examiner

*Primary Examiner*—David B Jones
(74) *Attorney, Agent, or Firm*—Clark Hill PLC

(57) ABSTRACT

A riveting yoke assembly (11) comprises a yoke (30), a force applying mechanism (22) and a rivet forming device (34, 36). The yoke has a first end (38), a second end (40), and a middle section (42) coupled between the first and second ends (38,40). An opening (44) is formed through the yoke between the first and second ends. The force applying mechanism (22) is coupled to the first end (38) of the yoke (30). The lower rivet forming device (36) is removably coupled to the second end (40) of the yoke. The lower rivet forming device (36) has a base end (46) attached to the second end (40) of the yoke (30) and a forming end (48) with a recess (50) to form rivets (17). The recess (50) has a concave, interior surface (52) having an annular step (54) positioned between a top edge (56) of the interior surface (52) and a bottom-most point (58) of the interior surface (52) in order to properly align the rivet (17).

6 Claims, 11 Drawing Sheets

RIVETING APPARATUS

FIELD OF INVENTION

This invention relates to devices and methods for riveting. More specifically, the invention relates devices and methods employing rivet forming elements.

DESCRIPTION OF BACKGROUND INFORMATION

There are various techniques for forming a rivet between two pieces of material. One such technique includes using a C-shaped yoke with forming tools at opposite ends of the yoke. However, after forming many rivets with such a yoke, failure of various components of the yoke assembly, such as, the forming tools, occurs and necessitates the replacement of the entire yoke. This results in prior art yokes being expensive and inefficient since prior art yokes often require replacement, which results in the expense of new, replacement yokes, and the halting the riveting process while the yokes are being replaced.

One riveting device is disclosed in U.S. Pat. No. 5,771,551 to Schurter et al., the contents of which are incorporated herein by reference.

SUMMARY

A riveting yoke assembly is provided according to the principles of the illustrated embodiment of the present invention including a riveting yoke assembly, comprising a yoke having a first end, a second end, and a middle section coupled between the first and second ends, the middle section forming an opening between the first and second ends; a force applying mechanism coupled to the first end; and a rivet forming device coupled to the second end of the yoke, the rivet forming device having a base end and a forming end, the base end being attached to the second end of the yoke and the forming end having a first recess to form an unformed end of a rivet, the first recess having a concave, interior surface, with an annular step positioned between a top edge of the interior surface and a bottom-most point of the interior surface.

A riveting yoke assembly is also provided according to the principles of the illustrated embodiment of the present invention including a riveting yoke assembly a riveting yoke assembly, comprising a yoke having a first end, a second end, and a middle section coupled between the first and second ends, the middle section forming an opening between the first and second ends; a force applying mechanism coupled to the first end; and a rivet forming device removably coupled to the second end of the yoke, the rivet forming device having abase end and a forming end, the base end being removably attached to the second end of the yoke and the forming end having a recess to form an unformed end of a rivet.

A riveting yoke assembly is further provided according to the principles of the illustrated embodiment of the present invention including a riveting yoke assembly a riveting yoke assembly, comprising a yoke having a first end, a second end, and a middle section coupled between the first and second ends, the middle section forming an opening between the first and second ends; a force applying mechanism coupled to the first end, the force applying mechanism including a shaft movable within an aperture in the first end of the yoke; a bushing positioned within said aperture and between the shaft and the yoke; and a rivet forming device removably coupled to the second end of the yoke, the rivet forming device having a forming end having a recess to form an unformed end of a rivet.

Other objects, features and advantages of the illustrated embodiment of the present invention will become apparent from the following detailed description, the accompanying drawings, and the appended claims.

BRIEF DESCRIPTION OF THE DRAWINGS

The illustrated embodiment of the present invention is further described in the detailed description which follows, by reference to the noted drawings by way of non-limiting exemplary embodiments, in which like reference numerals represent similar parts throughout the several views of the drawings, and wherein.

DETAILED DESCRIPTION

Figure 1:
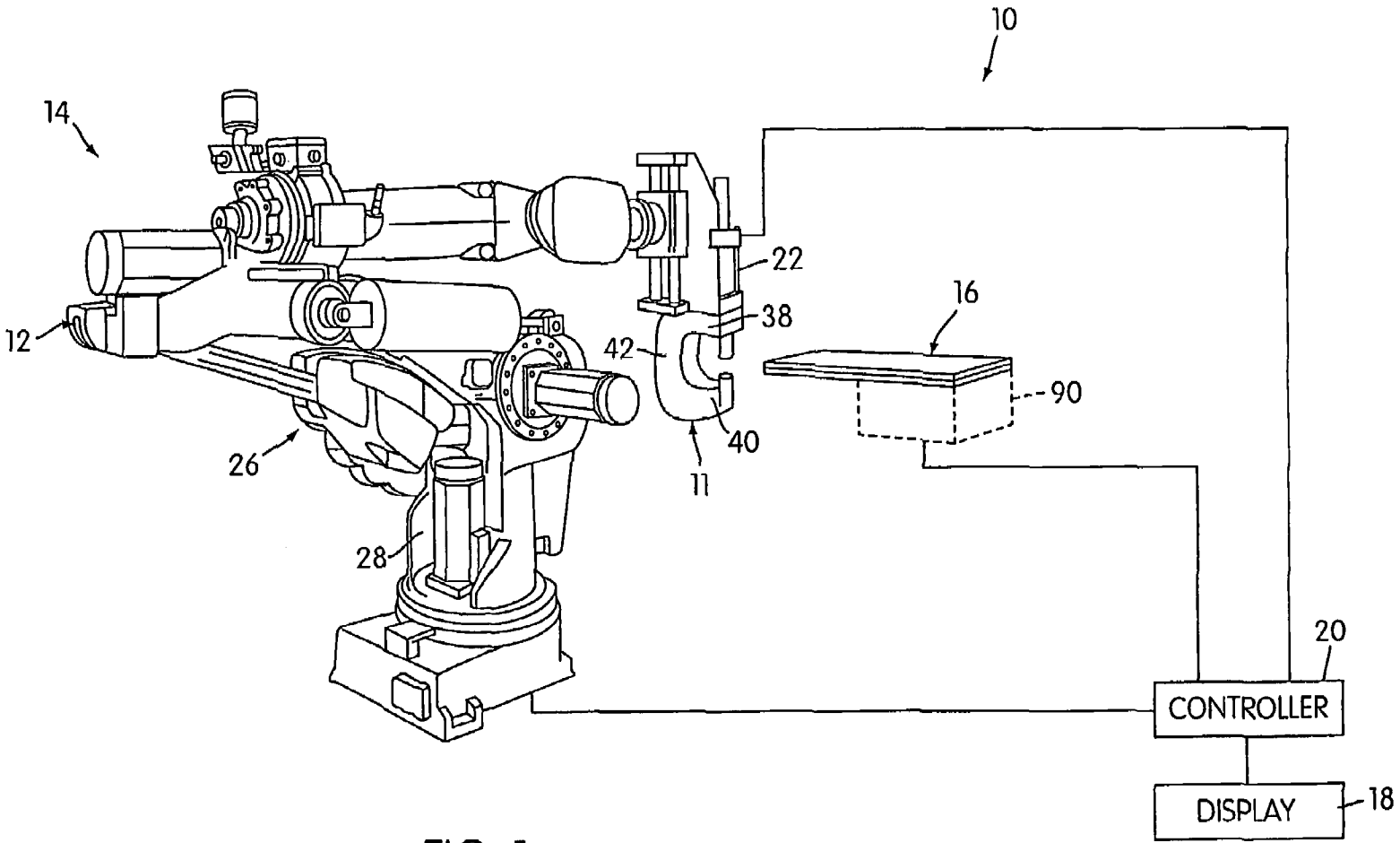
FIG. 1 is an illustration of a riveting system in accordance with one illustrated embodiment of the present invention including a perspective view of a riveting apparatus within a schematic diagram of a riveting system.
Figure 2:
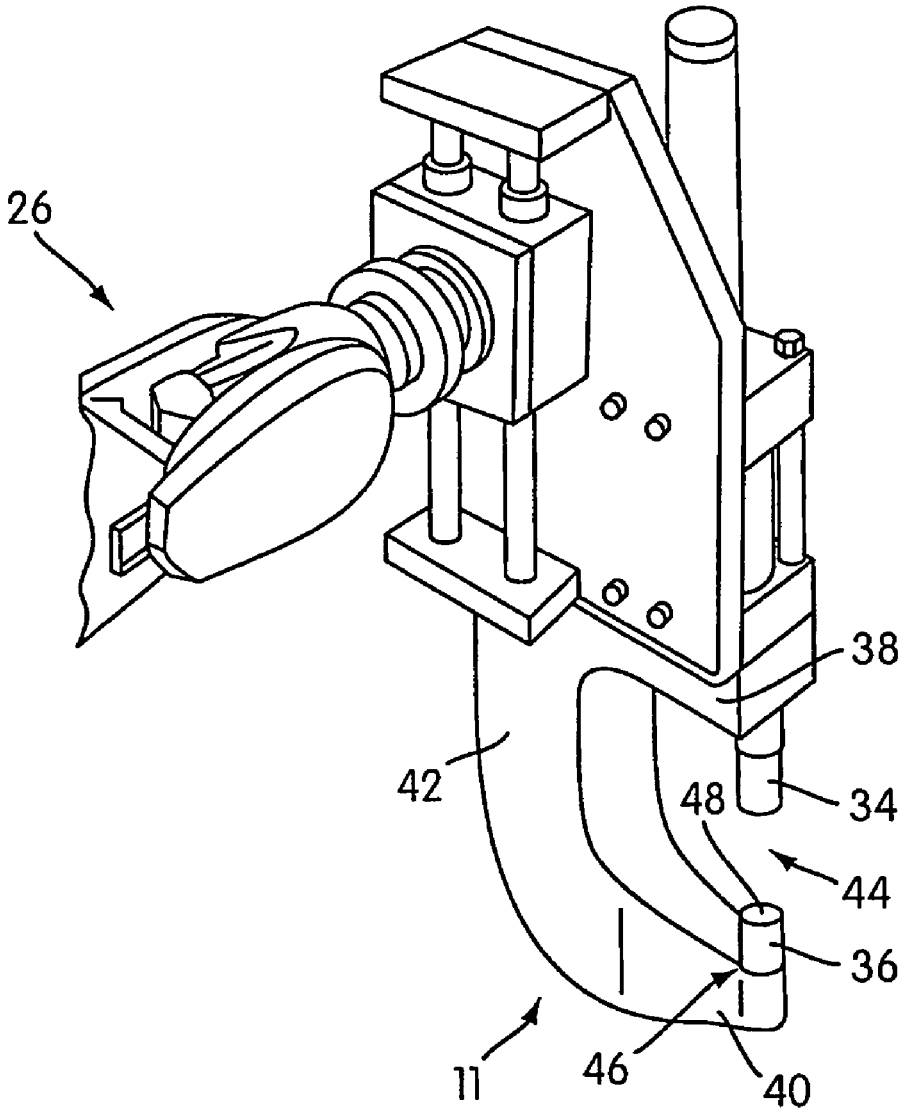
FIG. 2 is a perspective view of a riveting yoke assembly shown in FIG. 1.

Referring to FIG. 1, in accordance with one illustrated embodiment of the present invention, there is provided a riveting system 10 including a rivet yoke assembly 11 that can be employed by, for example, a riveting apparatus 12 configured to form rivets 17 in a riveting process, such as in automated manufacturing for coupling riveted members 16 together. For example, the riveting apparatus 12 can be employed in an automated manufacturing system for a manufacturing line, such as a manufacturing line 14, as shown in FIG. 1.

The riveting system 10 monitors the forces applied to a rivet 17 by force applying mechanisms to determine whether those forces were applied consistent with predetermined methods and values. If so, the rivet is considered to be correctly attached to the riveted members 16. If the force applied to a rivet 17 is not applied with the predetermined method and to the predetermined values, that rivet 17 can be identified and subjected to further inspection, such as visual inspection. System 10 can include a display monitor 18 (FIGS. 1 and 12) or other equipment for displaying the obtained rivet quality characteristics to a manufacturing line operator. The yoke assembly 11 is designed to have improved performance and enhanced service life. As a modular system, if a failure occurs within the yoke assembly 11, it does not result in a complete replacement of the yoke assembly 11. Thus, the system 10 provides an improved apparatus and method for riveting.

As shown in FIG. 1, the riveting apparatus 12 may include a force applying mechanism such as a hydraulic cylinder 22 coupled to the riveting yoke assembly 11. A power supply system such as a hydraulic motor pump assembly 24 (FIG. 12) can be configured to pump hydraulic fluid into and out from the hydraulic cylinder 22.

The hydraulic motor pump assembly 24, as controlled by the servo valve 86, provides pressure and flow of hydraulic fluid required to activate the hydraulic cylinder 22, i.e., move a hydraulic cylinder piston 32 (FIG. 3) certain distances within the hydraulic cylinder 22 between an inoperative position (retracted position) and an operative position (extended position), for example.

A controller 20 as shown in FIG. 1, connected to the riveting system 10, can control the adjustment of the pressure and flow of the hydraulic fluid required to activate the hydraulic cylinder 22 via the servo valve 86.

FIG. 1 shows the rivet yoke assembly 11 employed by the riveting apparatus 12. The riveting apparatus 12 is configured to form rivets, such as rivet 17 joining riveted members 16, in a riveting process such as might occur in automated manufacturing. As illustrated, the riveting apparatus 12 includes a robot 26 as is generally known in the art. The robot 26 is mechanically coupled to the rivet yoke assembly 11 and is configured to control positioning and orientation of the rivet yoke assembly 11 via the controller 20. The control of the robot 26 and the system 10 can be accomplished in a variety of ways, such as those illustrated in FIG. 1. Alternatives are also possible as a robotic controller (not shown) can be housed in a body 28 of robot 26 or the riveting apparatus 12 and be configured to control the robot 26 and the system 10, or control the robot 26 in communication with controller 20. The robot 26 can be any appropriate robotic mechanism such as those generally known in the art and can be manually or automatically controlled, such as, for example, by the robotic controller.

Figure 3:
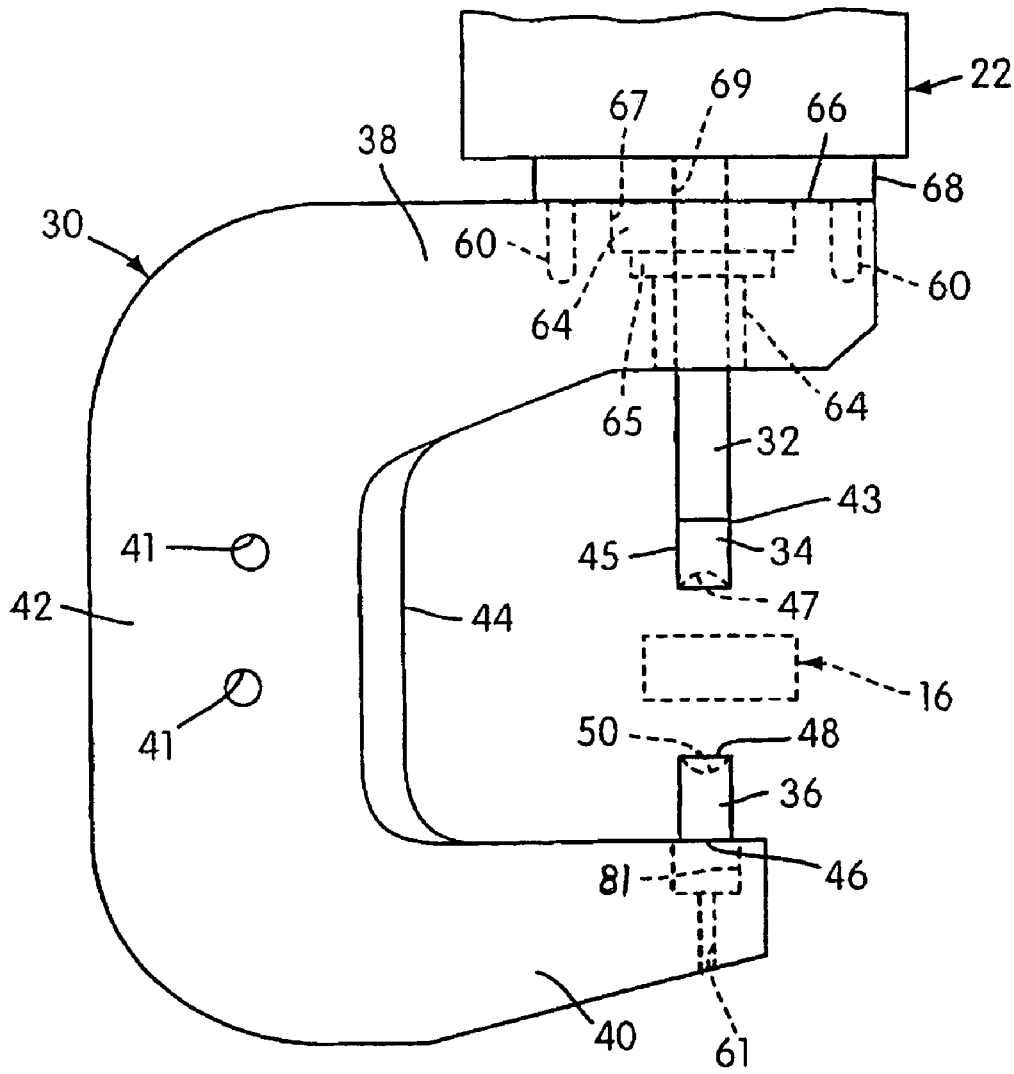
FIG. 3 is a enlarged side view showing the riveting yoke assembly shown in FIG. 1, with a riveted element positioned between first and second rivet forming devices of the riveting yoke assembly.
Figure 4:
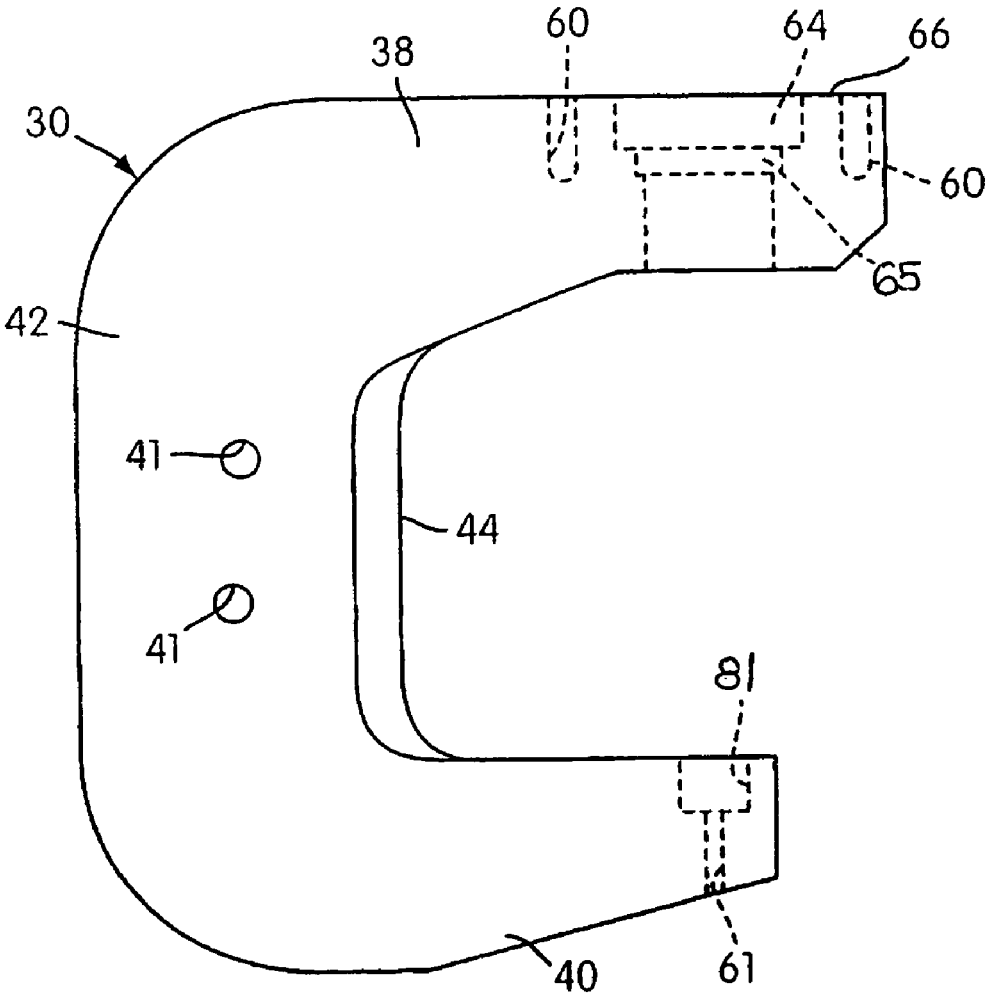
FIG. 4 is a side view showing the riveting yoke assembly shown in FIG. 3.
Figure 5:
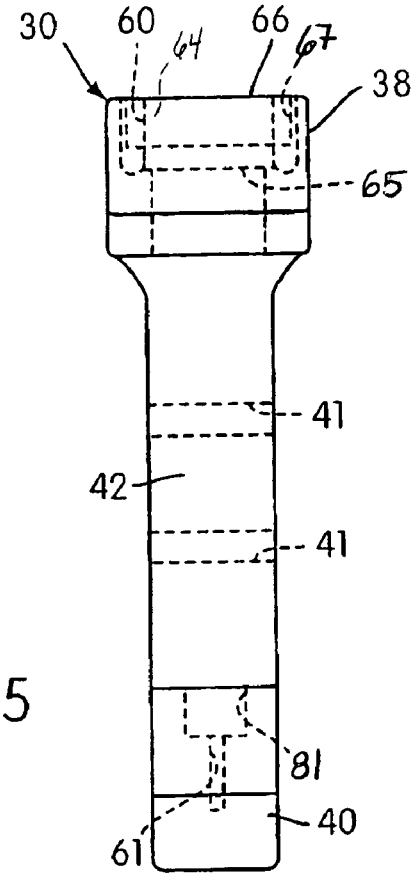
FIG. 5 is a front view of the riveting yoke assembly shown in FIG. 4.
Figure 6:
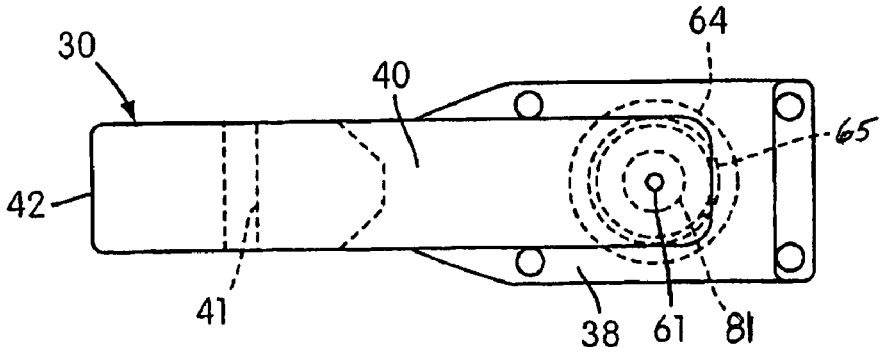
FIG. 6 is a bottom view of the riveting yoke assembly shown in FIG. 4.

FIGS. 2–6 best show the riveting yoke assembly 11, with FIGS. 4–6 showing a yoke 30 of the riveting yoke assembly 11 without upper and lower forming devices 34, 36 coupled thereto. The riveting yoke assembly 11 comprises the yoke 30, a force applying mechanism such as a hydraulic cylinder 22 and the upper and lower forming devices 34, 36, respectively. The yoke 30 has a first or upper end 38, a second or lower end 40, and a middle section 42 coupled between the first and second ends 38, 40, respectively. The upper end 38 is disposed in vertical spaced relation with respect to the lower end 40 and is positioned generally parallel to the lower end 40. The first and second ends 38, 40 cooperate with the middle section 42 to form a generally C-shaped configuration, such that an opening 44 is formed through the yoke 30 between the first and second ends 38, 40, for receiving the riveted members 16.

The yoke 30 can be made from metal or some other sufficiently rigid material, for example, steel such as P-20 1% nickel, or ASTM (American Society for Testing and Materials) 2714, which is preferred. In an alternative embodiment (not shown) the yoke 30 can be formed into other shapes, which permit rivet forming functions.

FIGS. 3, 4 and 5 show a plurality of openings 41 extending through the middle section 42. The openings 41 may be configured to receive fasteners therethrough as deemed necessary or desired. For example, fasteners extending through openings 41 can couple the middle section 42 of the yoke 30 to other supports or to provide attachments to the yoke 30.

The upper forming device 34, as illustrated, is rigidly coupled to the hydraulic cylinder piston 32 such that the upper forming device 34 moves with the piston 32 as the piston 32 moves from its inoperative position to its operative position.

A bushing 64, such as a lined guide bushing, can be positioned within the upper end 38, for example, to be level with an upper surface 66 of the upper end 38, as shown in FIGS. 3–5. Bushing 64 can be generally cylindrical and can include a step 65 if desired. Bushings 64 as illustrated in FIG. 3 can extend within the entire extent of upper end 38. Bushing 64 is received within an annular aperture 67 in upper end 38 and has an inner annular opening 69 for slidingly receiving piston 32. Bushing 64 can be any appropriate bushing material but is preferably a plastic bushing such as a RULON lined guide bushing. The bushing 64 aligns the cylinder piston 32 and permits easy change-outs of the bushing 64 at regular intervals without scrapping an entire yoke 30. For example, the bushings 64 could be changed every six months.

Figure 10:
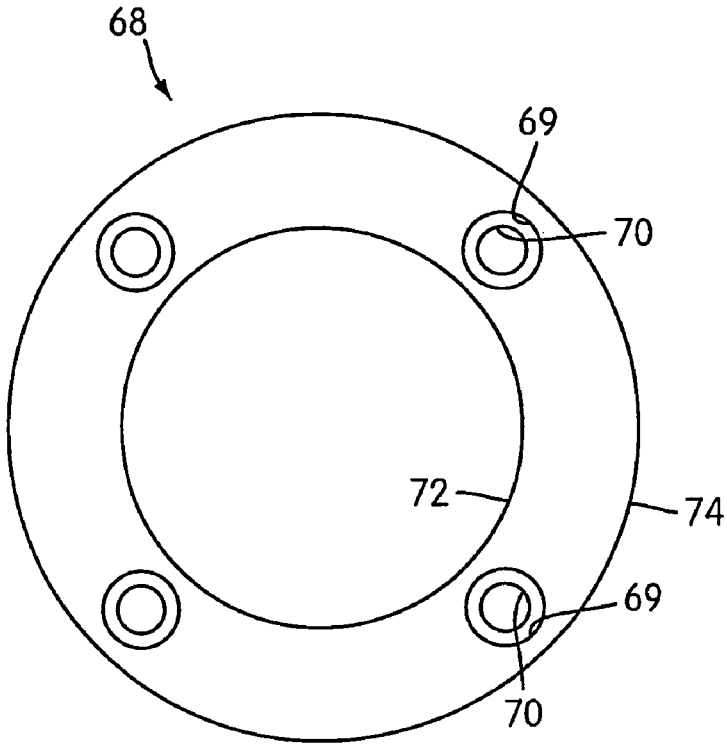
FIG. 10 is a top view of a ring for attaching the yoke to a hydraulic cylinder.
Figure 11:
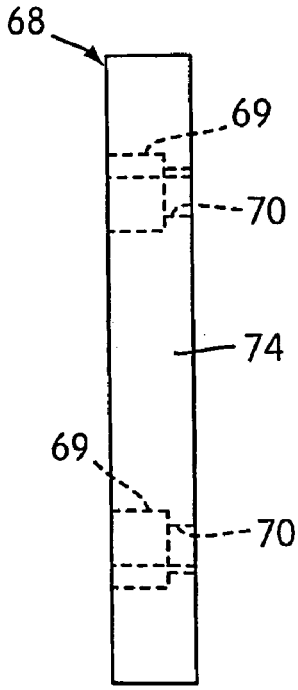
FIG. 11 is a side view of the ring shown in FIG. 10.

As shown in FIG. 3, the hydraulic cylinder 22 is coupled to the upper end 38 of the yoke 30 by a rivet yoke support ring 68. FIGS. 10 and 11 show a rivet yoke support ring 68 in greater detail. FIG. 3 shows the mounting plate 68 interposed between the yoke 30 and the hydraulic cylinder 22. The plurality of fastener receiving openings 60 in the upper end 38 of the yoke 30 align with openings 70 in the mounting plate 68 such that fasteners can extend therethrough the aligned openings to releasably couple the yoke 30 to the hydraulic cylinder 22. Preferably, each opening has a countersunk portion 69 such that the head of a fastener, such as a cap screw, can be received in the opening 70. The support ring 68 can extend the life of the bushings 64.

The hydraulic cylinder 22 can be of typical construction, although appropriately dimensioned for the specific requirements of the riveting process. Although the specific characteristics and features of the cylinder 22 will depend on the specific application, one example of cylinder 22 configuration may include a cylinder operating at approximately 2800 pounds per square inch of hydraulic pressure with a cylinder bore size of 4 inches. Such a configuration can equate to approximately 17 tons of force placed on the rivet 17.

The upper forming device 34 can have a base 43 end attached to the hydraulic cylinder piston 32. The upper forming device 34 can be threaded on piston 32 or attached in other ways. The upper forming device 34 can also have a forming end 45 to receive a formed end 210 of rivet 17.

Forming end 45 can have a recess 47 shaped to mate with the formed end 210 of rivet 17, whatever the shape of the formed end 210 of the rivet may be.

Figure 14:
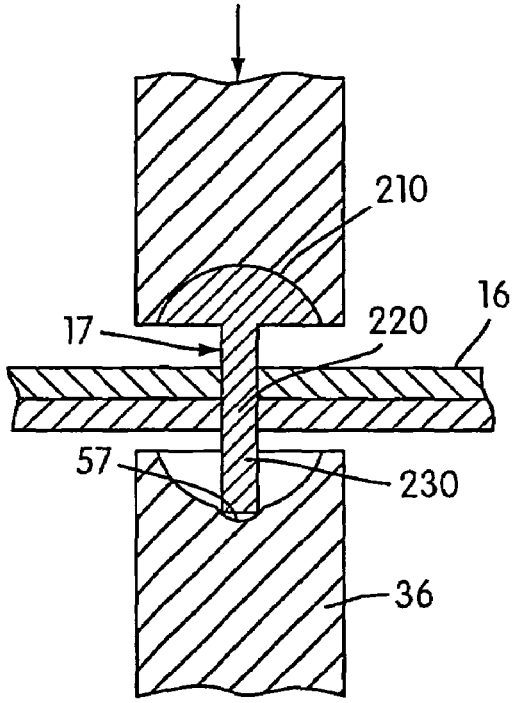
FIG. 14 is a cross-sectional view of the upper and lower rivet forming devices and showing the rivet prior to beginning the upset process of securing the rivet to the riveted members, with the rivet positioned within an opening of the riveted members and the formed end of the rivet positioned within the upper rivet forming device.
Figure 15:
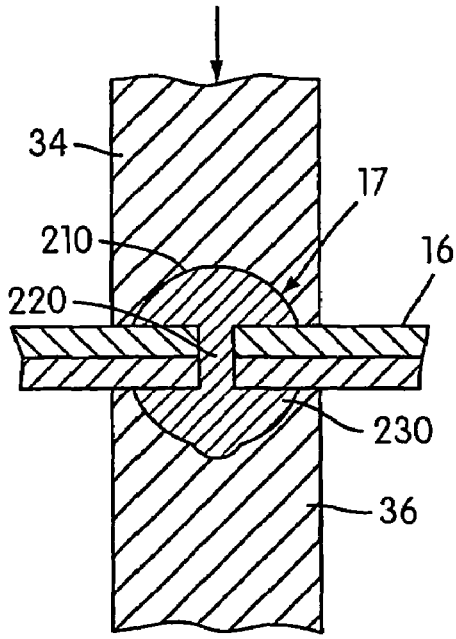
FIG. 15 is a cross-sectional view similar to FIG. 14 but showing the upper and lower rivet forming devices as the rivet is fully formed and secured to the riveted members.

As illustrated in FIGS. 14 and 15, the formed end 210 of rivet 17 is convex, so the forming end 45 of the upper forming device 34 is concave.

The lower forming device 36 is preferably removably coupled to the lower end 40 of the yoke 30 yet remains fixed to the lower end 40 during movement of the hydraulic cylinder piston 32. The lower forming device 36 has a base 46 end removably attached to the lower end 40 of the yoke 30. This attachment with the lower end 40 can be accomplished in various ways, for example, the base 46 can be threaded to be received with lower end 40 or can be inserted into lower end 40 and then secured by a threaded fastener. For example, a fastener could extend through fastener-receiving opening 61 to removably couple the lower forming device 36 to the lower end 40 of the yoke 30. Thus, the lower forming device 36 can be easily removed from the lower end 40 in the event that the lower forming device must be replaced for any reason, such as, if the lower forming device breaks or becomes worn. And this replacement of the lower forming device 36 can occur without the replacement of the yoke 30, thus realizing cost and time savings.

Figure 7:
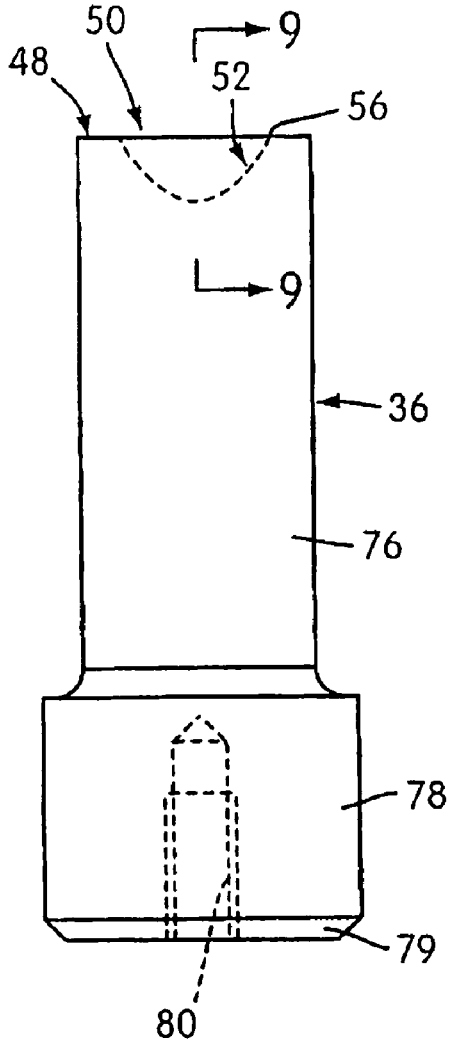
FIG. 7 is a side view of the lower rivet forming devices shown in FIG. 3 and removed from the yoke.
Figure 8:
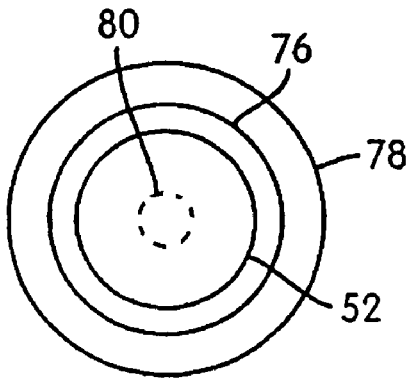
FIG. 8 is a top view of the second rivet forming device shown in FIG. 7.

The lower forming device 36 also has a forming end 48 with a recess 50 to form and upend a rivet 17. FIGS. 7 and 8 show the lower forming device 36 in greater detail than shown in FIG. 3. The lower forming device 36 includes a cylindrical body portion 76 and an enlarged shank portion 78, which is coupled to the cylindrical body portion 76. The cylindrical body portion 76 extends between the enlarged lead portion 78 and the forming end 48 and has the recess 50 formed therein. The enlarged shank portion 78 has a beveled surface 79. The shank portion 78 defines a centrally positioned fastener-receiving opening 80 therein.

FIGS. 3 and 4 best show the base 46 of the lower forming device 36 positioned within a seat portion 81 of the lower end 40 of the yoke 30.

A fastener may extend through the opening 61 in the lower end 40 of the yoke 30 and the fastener-receiving opening 80 to removably fasten the lower forming device 36 to the yoke 30 when the base 46 is positioned within the seat portion 81.

The fastener-receiving opening 80 may be threaded, for example, to threadedly engage the fastener and to allow easy removal and replacement of the forming device 36 from the yoke 30.

Figure 9:
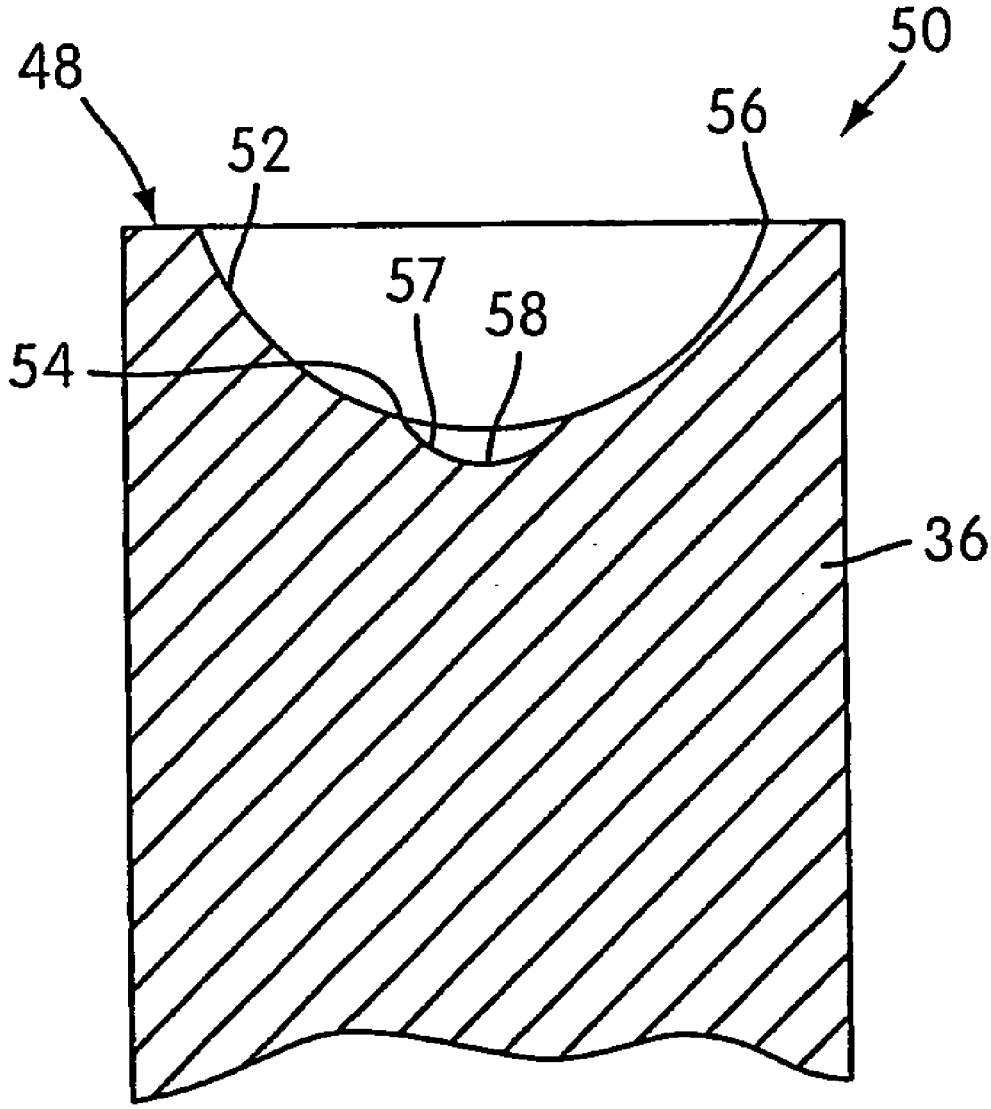
FIG. 9 is a cross sectional view taken along line 9—9 in FIG. 7.

FIG. 9 shows the forming end 48 and the recess 50 formed in the second forming device 36 in greater detail than FIGS. 7 and 8. As illustrated, the recess 50 has a concave, interior surface 52, with the interior surface 52 having an annular step 54 positioned between a top edge 56 of the interior surface 52 and a bottom-most point 58 of the interior surface 52. The annular step 54 can be formed in the interior surface 52 in any known manner, for example, by machining.

The interior surface 52 can be continuous from the top edge 56 to the annular step 54 and can be continuous from the annular step 54 to the bottom-most portion 58. The annular step 54 and the bottom-most portion 58 cooperate to form a circular depression 57, which is configured to receive a portion of one rivet 17.

The interior surface 52 can be formed such that the interior surface 52 forms a first radius of curvature above the annular step 54 and a second radius of curvature below the annular step 54 that is less shallow than the first radius of curvature. As seen in FIGS. 14 and 15, the depression 57 below the annular step 54 acts to center the forming end of rivet 17 to ensure a proper alignment of the rivet with respect to riveted members 16 and to the forming devices 34 and 36 and to the force applied by the cylinder 22. Since the depression 57 can guide the rivet 17 straight, the amount of improperly fastened rivets 17 can be dramatically reduced.

The rivet 17 can be any type of rivet or any type of force-applied fastener. As illustrated, rivet 17 includes a formed portion 210, a middle section 220, and a formed end 230. Although the rivet 17 is illustrated as having, for instance, a convex formed portion 210, the rivet 17 can be of any appropriate or desired configuration, depending in part on the requirements of the bond to be formed by rivet 17.

Figure 12:
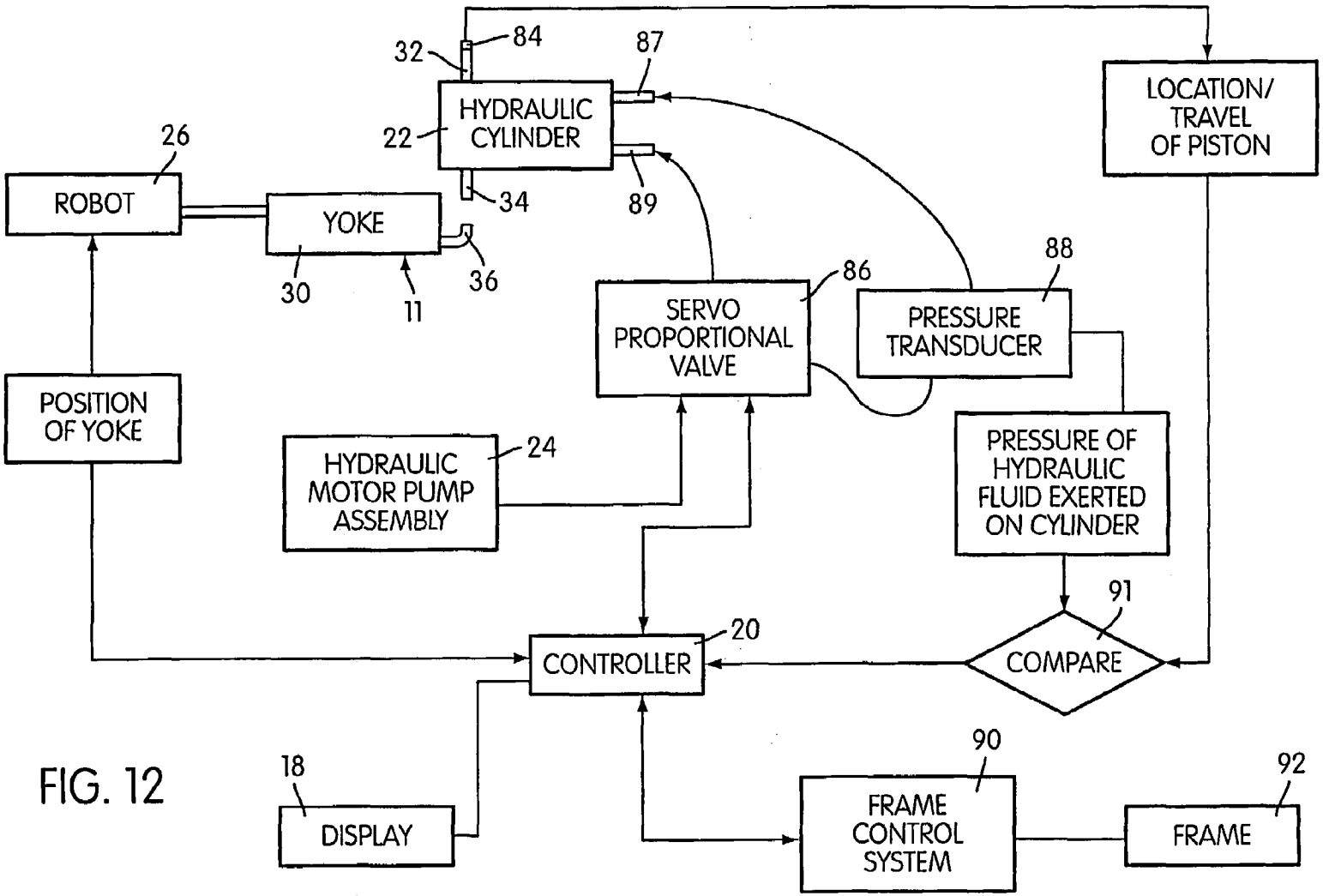
FIG. 12 is a functional block diagram of one implementation of the riveting system illustrated in FIG. 1.

FIG. 12 is a schematic diagram of the riveting system 10. The hydraulic cylinder 22 and the robot 26 are coupled to the riveting apparatus 12, as described above. The robot 26 is electrically coupled to the rivet yoke assembly 11 and is configured to control positioning and orientation of the rivet yoke assembly 11.

A servo-proportional valve 86 or any other hydraulic servo valve may be coupled to the hydraulic motor pump assembly 24 and to the hydraulic cylinder 22 to control the hydraulic fluid being pumped through the hydraulic motor pump assembly 24. As a result, the servo-proportional valve 86 can control the speed and distance of the hydraulic cylinder piston 32. As best seen in FIG. 12, a pressure transducer 88 is coupled to an inlet 89 of the hydraulic motor pump assembly 24 and is configured to provide feedback to the controller 20, such as a pressure signal representing a hydraulic fluid pressure exerted on the hydraulic cylinder piston 32. The amount of pressure to be exerted could be set so that the output of the pump assembly 24 outputs the desired pressure.

The controller 20, for example, could operate the servo-proportional valve 86 to extend or retract the piston 32, which in turn, extends or retracts the first forming device 34 based on algorithms, for example. The algorithms may produce "axis motion profiles" based upon the position of the piston 32 versus pressure measured at the inlet 89 of the hydraulic cylinder 22. The "axis motion profiles" represent comparison data generated from the position and pressure signals obtained from the linear transducer 84 and the pressure transducer 88, respectively. The "axis motion profiles" are used to determine the linear position of the piston 32 as well as to maintain a desired pressure at the inlet 89 of the hydraulic cylinder 22.

The controller 20 can perform the comparison of the linear transducer 84 and the pressure transducer 88, which is represented in FIG. 12 by reference numeral 91. The "axis motion profiles" can be outputted to the servo-proportional valve 86 based upon desired performance, e.g., programmable values of the controller 20, to extend or retract the piston 32.

During the advance stroke or extension of the piston 32, the controller 20 monitors the pressure via a pressure signal from the pressure transducer 88. The cylinder 20 preferably operates at low pressure until the upper forming device 34 contacts the rivet surface 210 at which point, the profile shifts to its pressure cycle and completes the compression of the rivet 17. The pressure values measured at the inlet 87 of the hydraulic cylinder 22 are continuously monitored and are constantly compared to the linear values representing the position of the piston 32 that are outputted from the linear transducer 84. The pressure and position signals outputted from the linear transducer 84 and the pressure transducer 88, respectively, can either be analog or digital signals that can be transmitted over a wired or wireless network, for example.

The controller 20 can be configured to detect certain faults within the riveting system 10, such as, for example, high pressures, out of linear limits and loss of feedback signals. For example, if the pressure measured at the inlet 87 builds up too early (is too high) when compared to the piston position, then the rivet to be riveted could be too long and if the pressure measured at the inlet 87 builds up to late (is too low) when compared to the piston position, then the rivet to be riveted could be too short, for example. The controller 20 also monitors the final riveted product, such as an automotive chassis, to ensure that all the parts being riveted together are present. If a defect occurs, the controller 20 can track the defective rivet through the riveting process. A manual inspector, for example, could inspect rivet data of the defective rivets on the display 18, as discussed above.

A controlled "axis motion profile" can be configured to prohibit the hydraulic piston 32 from fully extending, for example, if an obstruction is present between the rivet 17 and one or both of the first and second forming devices 34, 36.

A frame control system 90 may be coupled to the controller 20 and may be controlled by the controller 20. The frame control system 90 is configured to control positioning and orientation of a frame 92, such as an automobile chassis, that is to be riveted during a riveting process. The frame control system 90 may include both hardware and software to monitor and position the frame 92 into proper placement to be riveted by the riveting apparatus 12, for example, using manufacturing line 14 shown in FIG. 1.

If the riveting system ascertains that a rivet under inspection does not meet a predetermined standard, a mechanical diverter (not shown) or some other controllable device, connected to the riveting system 10 can be signaled to remove a faulty rivet (not shown) from the line 14 when the faulty rivet is conveyed to the location of the diverter. The diverter can move the faulty rivet off the line 14 and into, e.g., a storage receptor (not shown) for rejected rivets.

Figure 13:
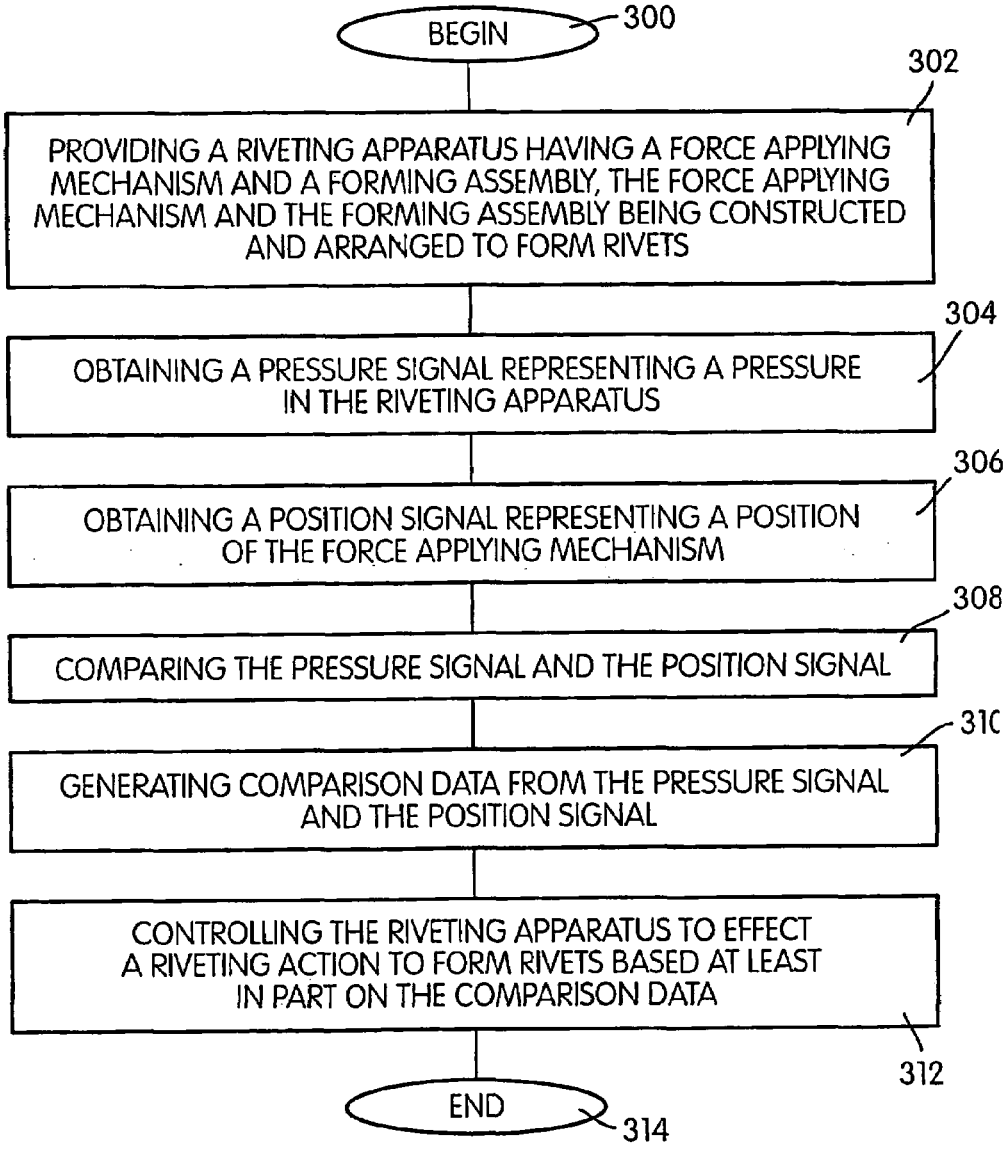
FIG. 13 is a functional block diagram of another implementation of the riveting system illustrated in FIG. 1.

FIG. 13 is a flow chart showing a method of using the riveting system shown in FIG. 1. The method begins at 300. At 302, a riveting apparatus, such as the riveting apparatus 12, is provided. The riveting apparatus has a force applying mechanism, such as a piston 32 within a hydraulic cylinder 22, and a forming assembly, such as upper and lower forming devices 34, 36. The force applying mechanism and the forming assembly are constructed and arranged to form rivets, such as rivet 17, for example.

At 304, a pressure signal representing a pressure in the riveting apparatus is obtained and a position signal representing a position of the force applying mechanism, e.g., the linear travel of the piston 32 within the hydraulic cylinder 22 is obtained. The linear travel of the piston 32 includes travel to its operative or extended position from its inoperative or retracted position.

At 308, the pressure signal and the position signal are compared, for example, by the controller 20 (FIG. 12). At 310, comparison data is generated from the pressure signal and the position signal. At 312, the riveting apparatus is controlled, for example, by a controller and a microprocessor, for example, to effect a riveting action which forms rivets based at least in part on the comparison data.

Hence, it is within the principles of the present invention for the riveting system 10 to be operated to manually form rivets (as illustrated shown in relation to FIG. 13) or to be operated in an automated fashion, either in full or in part, to form rivets (as illustrated in relation to FIG. 1).

It should be understood that the riveting system 10 can be implemented, for example, as portions of a suitably programmed general-purpose computer. It should also be understood that the system may be implemented, for example, as physically distinct hardware circuits within an system. For example, although the system 10 has been described as a general-purpose computer, for example, a personal computer, it is foreseeable that the system 10 may be a special purpose embedded processor.

While the invention has been described with reference to certain illustrated embodiments, the words which have been used herein are words of description rather than words of limitation. Changes may be made, within the purview of the appended claims, without departing from the scope and spirit of the invention is its aspects. Although the invention has been described herein with reference to particular structures, acts and materials, the invention is not to be limited to the particulars disclosed, but rather extends to all equivalent structures, acts, and materials, such as are within the scope of the appended claims.

What is claimed is:

1. A riveting yoke assembly, comprising:

a yoke having a first end with a plurality of fastener receiving openings, a second end with an opening extending therethrough, and a middle section coupled between said first and second ends, said middle section forming an opening between said first and second ends;

a force applying mechanism releasably coupled to said first end via said plurality of fastener receiving openings in said first end; and a rivet forming device removably coupled to said second end of said yoke, said rivet forming device having a base end and a forming end, said base end being attached to said second end of said yoke via said opening in said second end and said forming end having a first recess to form an unformed end of a rivet, said first recess having a concave, interior surface, with an annular step positioned between a top edge of said interior surface and a bottom-most point of said interior surface.

2. A riveting yoke assembly according to claim 1, wherein said yoke is formed from steel.

3. A riveting yoke assembly according to claim 1, wherein said force applying mechanism is a hydraulic cylinder.

4. A riveting yoke assembly according to claim 1, wherein said force applying mechanism has an rivet engaging device to engage a formed head of a rivet.

5. A riveting yoke assembly according to claim 1, wherein said interior surface has a first radius of curvature on an outer side of said annular step and a second radius of curvature on an inner side of said annular step.

6. A riveting yoke assembly according to claim 5, wherein said first radius of curvature is greater than said second radius of curvature.

* * * * *